United States Patent [19]

Bobrovnikov et al.

[11] 4,187,652

[45] Feb. 12, 1980

[54] SPACE STRUCTURE OF A ROOF COVERING FOR A BUILDING

[76] Inventors: Anatoly P. Bobrovnikov, ulitsa Usacheva, 25, kv. 91; Alexandr V. Zakharov, ulitsa Kooperativnaya, 10, kv. 8; Gennady I. Soloviev, ulitsa Davydkovskaya, 6, kv. 102; Gennady G. Mikhailov, Mozhaiskoe shosse, 24, kv. 298; Tamara N. Golubeva, Gvardeiskaya ulitsa, 13, kv. 19; Nina N. Glushkova, Malaya Filevskaya ulitsa, 48, kv. 58, all of Moscow, U.S.S.R.

[21] Appl. No.: 942,148

[22] Filed: Sep. 14, 1978

[51] Int. Cl.[2] ..... E04C 3/02

[52] U.S. Cl. ..... 52/90; 52/223 R; 52/222; 52/638; 52/643

[58] Field of Search ..... 52/86, 90, 92, 93, 222, 52/223 R, 227, 229, 231, 633, 634, 638, 639, 643, 644

[56] References Cited

U.S. PATENT DOCUMENTS

| | | | |
|---|---|---|---|
| 2,753,601 | 7/1956 | Brunton | 52/639 X |
| 2,943,366 | 7/1960 | Sanford | 52/643 X |
| 3,019,861 | 2/1962 | Rasch et al. | 52/639 |
| 3,058,549 | 10/1962 | Anderson | 52/90 X |
| 3,156,018 | 11/1964 | Slayter | 52/90 X |
| 3,352,070 | 11/1967 | Raynes | 52/90 X |
| 3,708,928 | 1/1973 | Gaspers | 52/90 |
| 4,100,708 | 7/1978 | Bobrovnikov et al. | 52/223 R |

FOREIGN PATENT DOCUMENTS

| | | | |
|---|---|---|---|
| 197805 | 5/1978 | Fed. Rep. of Germany | 52/90 |
| 88062 | 4/1958 | Netherlands | 52/639 |
| 6705316 | 10/1967 | Netherlands | 52/90 |
| 320594 | 11/1971 | U.S.S.R. | 52/90 |

*Primary Examiner*—J. Karl Bell

*Attorney, Agent, or Firm*—Haseltine, Lake & Waters

[57] ABSTRACT

Roof coverings may comprise one, two, three or more roof trusses including top and bottom longitudinal chords, diagonal rods and vertical posts by means of which the top chord is connected with the bottom chord. The roof trusses are interconnected by means of transverse bracing at distances sufficient to ensure lateral rigidity. Top and bottom abutment girder members are mounted at the ends of the top and bottom chords, respectively. Top and bottom purlins are arranged between the top and bottom abutment girder members at the same levels therewith in panel points of roof truss. The abutment girder members and purlins are secured to said top and bottom chords. Pre-stressed sheet coverings, supported by the abutment girder members and purlins, are secured to said members and purlins and to the longitudinal chords, with the abutment girder members keeping the sheet coverings tensioned and the longitudinal chords compressed. In an embodiment with two roof trusses, the top and bottom chords of each truss are made sectional lengthwise, with the connections between the sections made rigid. In an embodiment with three roof trusses, the top chord of each truss is made up of two longitudinal sections arranged in parallel with each other, one of said sections of the top chord of one of the trusses being connected with the other section of the top chord of another truss nearest it by means of abutment girder members, purlins and sheet covering, all forming a substantially flat panel extended in the longitudinal direction, while adjacent longitudinal sections of the top chord of each truss, belonging to the two adjoining panels, are interconnected by means of gusset plates provided between adjacent sections of the top chord, in places where the diagonal rods and vertical posts are attached to said top chord of each truss.

7 Claims, 28 Drawing Figures

SPACE STRUCTURE OF A ROOF COVERING FOR A BUILDING

The present invention relates to the field of construction and, more particularly, it relates to structures of roof coverings for buildings.

The present invention can be used advantageously in the construction of the various industrial and civil buildings, including production shops, store buildings, large auditoria, supermarkets and gymnasia, theater buildings, exhibition facilities and the like.

When constructing the afore-mentioned buildings, the choice of a roof covering structure is of considerable importance, the following requirements being usually placed upon the main load bearing members of said roof covering: low weight and cost of the covering proper; the possibility of its mass flowline production using highly efficient means of mechanizing and automating the manufacturing process; convenience in the storage, packing and delivery of the structure units to the place of assembly; the possibility of assembly and mounting using simple techniques and equipment; operating reliability and economy; pleasing architectural and esthetic appearance.

The most commonly used type of roof covering for industrial and some civil buildings has for its main bearing member roof trusses of diverse shapes, with perlins mounted thereon at the level of top chords and a roofing laid over said perlins. Known in the art is a triangular light steel truss structure for use in the afore-described roof covering system provided with two inclined web top chords whose top ends are rigidly connected in a peak joint and the bottom ends are braced together by means of a horizontal tie, i.e., bottom chord.

A disadvantage of above-mentioned roof covering structure consists in that it has a large number of constituent members whose assembly is to be done at an altitude after the trusses have been installed, which results in an increased labor consumption. Another disadvantage of said structure is its great weight due to the fact that the roofing material takes no part in the work done by the trusses. Moreover, the afore-described structure makes inadequate use of the possibility of unification of structural elements, which limits the scope of its application.

Known in the art is a roof covering block structure for industrial buildings, comprising two roof trusses interconnected by means of lateral purlins, vertical stiffeners and ties, and a roofing laid over said lateral purlins and consisting of shaped steel sheeting, heat insulator and layers of steam- and hydro-insulating coiled materials. Said structure has been developed as a standard one and is designed for flow-line production and block assembling.

A disadvantage of above-described structure is a heavy block weight and high labor consumption.

Known in the art is a structural member of roof covering for buildings, made as a membrane panel comprising a space frame with longitudinal top and bottom chords, perlins and a web system interconnecting the top and bottom chords, and sheet coverings connected to said frame, one of the cover sheet coverings being pre-stressed while the longitudinal chords adjoining said latter sheet coverings are made as sectional members whose sections are hinged to each other. When assembling said structural member, the process of assembly begins with the frame and the non-prestressed cover sheet, which present a flat panel. Attached to said panel by means of the web system are sections of the sectional chord with the exception of the outermost sections. The outermost sections are attached to the sheet covering which is to be pre-stressed, the sheet covering length being somewhat smaller than the overall length of the sectional chord. The difference in the length of the sheet covering and chord units is found by calculation, depending on the desired prestressing value. Thereupon, one of the outermost sections of the sectional chord is set in the design position, connection to the previously mounted chord section and fixed in position by means of the web system and a bearing vertical stiffener. While so doing, the other outermost section of the sectional chord takes an inclined position because of the length difference between the sheet covering and said chord, with a hinge provided in the place of its joint with the previously installed section of said chord, said hinge ensuring the possibility of said outermost section turning about the horizontal axis of two adjacent hinges of both sectional chords. The sheet covering is tensioned by turning said outermost section about the hinge to the design position, followed with the installation of the lacking diagonal rods and another bearing vertical stiffener.

Disadvantages of the above-described structure consist, first, in the complexity of design caused by the presence in the sectional chord connections of rather complicated hinge means which require special adjustment during manufacture while serving no useful function in further maintenance of the roof covering; second, in a high labor consumption in manufacture since, in view of the fact that the deformation of the longitudinal chords upon tensioning the sheet covering distorts the geometrical scheme of the space frame, the lacking diagonals and cross braces can only be installed in the vertical cross-sectional plane above the structure support after tensioning the sheet covering with their on-site adjustment. While so doing, the installation of the last diagonals and braces is to be done from an inconvenient position, this further complicating the manufacturing process. Moreover, the absence of direct control over the sheet covering tensioning, as well as the approximate nature of indirect methods of determining the sheet covering prestressing value, decreases the reliability of the structure.

Also known in the art is a steel-aluminum block panel structure comprising two roof trusses made of steel shapes and aluminum panel consisting of two longitudinal members such as chords, purlins and cover sheeting attached to said chords and purlins, the aluminum panel being combined in a single block panel with both trusses by way of connecting, via spacers, the longitudinal chords of the panel with the longitudinal top chords of the roof trusses. Several block panels of the afore-described design are joined in a single large-size block with the aid of subroff structures.

A disadvantage of the above-mentioned structure consists in the complexity of design and high labor consumption in manufacture.

The main object of the present invention is to provide a structure of a roof covering for a building, that would be characterized by a simpler manufacturing process and lower labor consumption in manufacture and assembly, as well as by a higher reliability of the structure in use.

It is another object of this invention to reduce the weight of the structure.

It is still another object of the present invention to unify the structures of roof coverings for buildings with a view to ensuring the possibility of their mass production using means of mechanizing and automating the manufacturing process.

It is yet another object of the present invention to expand the sphere of actual application of the structures for buildings with different spans.

In the accomplishment of said and other objects of the present invention, a space structure of a roof covering for a building, according to the invention, incorporates: at least two roof trusses, each comprising a top longitudinal chord and a bottom longitudinal chord, diagonal rods and vertical posts further referred to as diagonals and verticals by means of which said top chord is connected with said bottom chord; cross braces mounted in the vertical planes of cross-section of said space structure, said cross braces serving to interconnect said roof trusses and mounted at the ends of said structure and in the intermediate planes of cross-section between the structure ends at distances sufficient to ensure lateral rigidity of said structure; top and bottom face members provided at the ends of said top and bottom chords, respectively, and top and bottom purlins arranged between said top and bottom abutment girder members, respectively, at the same levels therewith in panel points of said truss, said top and bottom abutment girder members and top and bottom purlins being connected to the top and bottom chords, respectively; a top prestressed sheet covering and a bottom prestressed sheet covering, supported by the top and bottom abutment girder members and purlins, respectively, and attached to said members and purlins, and to said top and bottom chords, respectively, said top and bottom abutment girder members keeping said respective top and bottom sheet coverings tensioned and said respective top and bottom chords compressed; top and bottom flanges for securing said space structure to external means by which said top and bottom sheet coverings are tensioned, said flanges attached to the end faces of said top and bottom chords, respectively; in which structure, according to the invention, said top and bottom chords are made sectional lengthwise, with the connections between the sections of the top chords as well as the sections of the bottom chords made rigid.

The same objects are attained in a space structure of a roof covering for a building, incorporating: at least three roof trusses, each comprising a top longitudinal chord and a bottom longitudinal chord, diagonals, verticals and gusset plates by means of which said diagonals and verticals connect said top chord with said bottom chord; cross braces mounted in the vertical planes of cross-section of said space structure, said cross braces serving to interconnect said roof trusses and mounted at the ends of said structure and in the intermediate planes of cross-section between the structure ends at distances sufficient to ensure lateral rigidity of said structure; top abutment girder members provided at the ends of said top chords of each one of said roof trusses, and top purlins arranged between said top abutment girder members at the same level therewith in panel points of said truss, said abutment girder members and purlins being connected to said top chords; a top prestressed sheet covering supported by said top abutment girder members and purlins and attached to said members and purlins and to said top chord, said abutment girder members keeping said sheet covering tensioned and said top chord compressed; flanges for securing said space structure to external means by which said sheet covering is tensioned, said flanges attached to the end faces of said top chords of said roof trusses; in which structure, according to the invention, the top chord of each one of said trusses is made up of two longitudinal sections arranged in parallel with each other, one of said sections of the top chord of one of the trusses being coupled with the other one of the sections of the top chord of another truss nearest to it by means of said abutment girder members, purlins and sheet covering to form a substantially flat panel extended in the longitudinal direction, while adjacent longitudinal sections of said top chord of each truss, belonging to two adjoining ones of said panels, are interconnected by means of said gusset plates provided between said adjacent sections of said top chord, in places where said diagonals and verticals are attached to said top chord of each one of said trusses.

The same objects are further attained in a space structure of a roof covering for a building, incorporating: at least one roof truss comprising a top longitudinal chord and a bottom longitudinal chord, diagonals and verticals by means of which said top chord is connected with said bottom chord; cross braces mounted in the vertical planes of cross-section of said space structure and mounted at the ends of the latter and in the intermediate planes of cross-section between said ends at distances sufficient to ensure lateral rigidity of said structure; top and bottom abutment girder members provided at the ends of said top and bottom chords, respectively, and top and bottom purlins arranged between said top and bottom abutment girder members, respectively, at the same levels therewith in the panel points of said truss, said top and bottom abutment girder members and top and bottom purlins being connected to the top and bottom chords, respectively; a top prestressed sheet covering and a bottom prestressed sheet covering, supported by said top and bottom abutment girder members and purlins, respectively, said top and bottom abutment girder members keeping said respective top and bottom sheets covering tensioned and said respective top and bottom chords compressed; top and bottom flanges for securing said space structure to external means by which said top and bottom sheet coverings are tensioned, said flanges attached to the end faces of said top and bottom chords, respectively; prop, each resting with one of its ends against one of the verticals of said truss and, with another end, connected to said top abutment girder members and purlins, and suspenders serving to connect the external ends of said top abutment girder members and purlins with the respective ends of said bottom abutment girder members and purlins; in which structure, according to the invention, said top and bottom abutment girder members and purlins are made sectional, said top and bottom chords are parallel with each other and are arranged between sections of said top and bottom abutment girder members and purlins, while said top and bottom sheet coverings fit closely the upward- and downward-directed surfaces, respectively, of said respective top and bottom abutment girder members, purlins and chords and are attached to the latter.

It is expedient that said structure be manufactured from unified, mainly plane web parts of said roof trusses, said parts being formed of the respective component sections of the top and bottom chords connected to each other by means of the diagonals and verticals of said roof trusses.

In another embodiment of the present invention, it is expedient that the roof covering be made as a series of blocks of said space structures, each one of said blocks incorporating at least two of said structures, at least one auxiliary truss mounted in the same plane with the roof truss incorporated in each one of said space structures and having a top chord parallel with the bottom chords of the said roof trusses, and connecting means by means of which each space structure is connected to said top chord of the auxiliary truss, said connecting means being attached on one side to bearing edges of the roof trusses and to intermediate panel points of said trusses and, on the other side, to said top chord of the auxiliary truss, the connecting means that are attached to one of the bearing edges of each one of said roof trusses being made as hinged bearings immovable in all directions while the remaining connecting means are made as hinged bearings permitting of relative movement of said space structures and said top chord of the auxiliary truss in a direction parallel to the line of inclination of said top chord of the auxiliary truss and all said means are spaced from each other through distances sufficient for ensuring the buckling stability of the top chord of the auxiliary truss.

The herein disclosed invention resides in the following.

The space structure of a roof covering for a building incorporates: at least two roof trusses, each comprising a top longitudinal chord and a bottom longitudinal chord, diagonals and verticals by means of which said top chord is connected with said bottom chord; cross braces located in the vertical planes of cross-section of said space structure, said cross braces serving to interconnect said roof trusses and being mounted at the ends of said structure and in the intermediate planes of cross-section between the structure ends at distances sufficient to ensure lateral rigidity of said structure; top and bottom abutment girder members provided at the ends of said top and bottom chords, respectively, and top and bottom purlins mounted between said top and bottom abutment girder members, respectively, at the same levels therewith in the panel points of said truss said top and bottom abutment girder members and top and bottom purlins being connected to the top and bottom chords, respectively; a top prestressed sheet covering and a bottom prestressed sheet covering, supported by the top and bottom abutment girder members and purlins, respectively, the attached to said members and purlins and to said top and bottom chords, respectively, said top and bottom abutment girder members keeping the respective top and bottom sheet coverings tensioned and the respective top and bottom chords compressed; top and bottom flanges for securing said space structure to external means by which said top and bottom sheet coverings are tensioned, said flanges attached to the end faces of said top and bottom chords, respectively; in which structure, according to the invention, said top and bottom chords are made sectional lengthwise, with the connections between the sections of the top chords, as well as the sections of the bottom chords made rigid.

Thanks to such an arrangement of the space structure, the process of its manufacture does not require assembly of complicated hinged means in the connections between the sections of the roof truss sectional chords, while the rigid connection of the sections being joined is effected in a much simpler manner, for example, by means of a flange connection requiring no complicated adjustment or by way of butt welding said sections, or by means of butt straps. In addition, the provision of flanges attached to the end faces of said chords helps effect the tensioning of the sheet coverings by means of external means presenting no part of said structure, owing to which the tensioning of said sheet coverings is effected under conditions of fully assembled structure components such as chords, diagonals, verticals, cross braces in the end cross-sectional planes of the structure. Therefore, all of the variations of the geometrical scheme of the space frame of the structure upon deformations of the longitudinal chords in the course of tensioning the sheet coverings occur in a fully assembled structure. As a result, no in-situ adjustment is required of structural components such as verticals and diagonals and said cross braces in the vertical planes of end cross-section. The positioning of the cover sheet tensioning means outside of the structure helps to provide a direct control over the value of cover sheet tensioning, thereby improving the reliability of the structure.

It is clear from the foregoing that the herein disclosed invention results, owing to a simplified design of the structure, in a simpler manufacturing process, lower labor consumption in assembly and improved reliability of the roof covering structure.

The manufacturing process is rendered still simpler and the labor consumption in assembly lower by providing a roof covering for a building in the form of space structures incorporating: at least three roof trusses, each comprising a top chord and a bottom chord, diagonals, verticals and gusset plates by means of which said struts and posts connect said top chord with said bottom chord; cross braces mounted in the vertical planes of cross-section and said space structure, said cross braces serving to interconnect said roof trusses and mounted at the ends of said structure and in the intermediate planes of cross-section between the structure ends at distances sufficient to ensure lateral rigidity of said structure; top abutment girder members provided at the ends of said top chords of each one of said trusses, and top purlins arranged between said top end face members at the same level therewith in the panel points of said truss, said abutment girder members and purlins being connected to said top chords; a top prestressed sheet covering supported by said top abutment girder members and purlins and attached to said members and purlins and to said top chord, said abutment girder members keeping said sheet covering tensioned and said top chord compressed; flanges for securing said space structure to external means by which said top sheet covering, is tensioned, said flanges attached to the end faces of said top chords and said roof trusses; in which structure, according to the invention, the top chord of each one of said trusses is made up of two longitudinal sections arranged in parallel with each other; one of said sections of the top chord of one of the trusses being coupled with the other one of the sections of the top chord of another truss nearest it by means of said abutment girder members, purlins and sheet covering to form a substantially flat panel extended in the longitudinal direction, while adjacent longitudinal sections of said top chord of each truss, belonging to two adjoining ones of said panels, are interconnected by means of the gusset plates provided between said adjacent sections of said top chord, in places where said verticals and diagonals are attached to said top chord of each one of said trusses.

Thanks to such an arrangement of said space structure, the process of its assembly does not involve the steps of installing the top abutment girder members and purlins, uncoiling out the top sheet coverings, their subsequent tensioning and connecting them with the top chords of the roof trusses. The afore-listed operations are performed under factory conditions, while to the assembly sites are delivered finished panels with tensioned sheet coverings on and finished roof trusses in which continuous top chords are replaced with gusset plates, which also serves to simplify the design of the structure and the process of assembling the latter.

The own weight of a roof covering for a building can be reduced in a space structure incorporating: at least one roof truss comprising a top longitudinal chord and a bottom longitudinal chord, diagonals and verticals by means of which said top chord is connected to said bottom chord; cross braces located in the vertical planes of cross-section of said space structure and mounted at the ends of the latter and in the intermediate planes of cross-section between said ends at distances sufficient to ensure lateral rigidity of said structure; top and bottom abutment girder members provided at the ends of said top and bottom chords, respectively, and top and bottom purlins mounted between said top and bottom end face members, respectively, at the same levels therewith in the panel points of said truss, said top and bottom abutment girder members and top and bottom purlins being connected to the top and bottom chords, respectively; a top prestressed sheet covering and a bottom prestressed sheet covering, supported by said top and bottom abutment girder members and purlins, respectively, and attached thereto, said top and bottom abutment girder members keeping the respective top and bottom sheet coverings tensioned and the respective top and bottom chords compressed; top and bottom flanges for securing said space structure to external means by which said top and bottom sheet coverings are tensioned, said flanges attached to the end faces of said top and bottom chords, respectively; props, each resting with one of its ends against one of the verticals of the truss and, with another end, connected to said top abutment girder members and purlins, and suspenders serving to connect the external ends of said top abutment girder members and purlins with the respective ends of said bottom abutment girder members and purlins; in which structure, according to the invention, said top and bottom abutment girder members and purlins are made sectional, said top and bottom chords are parallel with each other and are arranged between sections of said top and bottom abutment girder members and purlins, while said top and bottom sheet coverings fit closely the upwardand downward-directed surfaces, respectively, of said top and bottom abutment girder members, purlins and chords and are attached to the latter.

Such an arrangement of the space structure helps, while keeping the same distance between the roof trusses, cut their number in two as compared with the afore-described embodiments, which is in keeping with the well-known principle of the concentration of material and results in a reduction of the roof covering weight thanks to a fuller utilization of the material.

The unification of structures of roof coverings for buildings is attained by manufacturing said roof coverings from space structures according to the afore-described embodiments, wherein the top chord of each roof truss is parallel with the bottom chord of said truss, both chords are made sectional lengthwise, while the sections of said top chord, connected to the respective sections of the bottom chord by means of said diagonals and verticals, form unified, mainly plane web parts. Said truss parts have uniform dimensions and are interchangeable for use in the structures of roof coverings for buildings with different spans and for different loads. Such an arrangement of said structure offers good possibilities for flow-line production of unified truss parts and single members using means of mechanizing and automating the manufacturing process.

The sphere of actual application of space structures of roof coverings for buildings can be expanded owing to the fact that said roof coverings can be made as series of blocks of said space structures, each one of said blocks incorporating at least two of said structures, at least one auxiliary truss mounted in the same plane with the roof truss incorporated in each one of said space structures and having a top chord parallel with the bottom chords of the roof trusses, and connecting means by means of which each space structure is connected to said top chord of the auxiliary truss, said connecting means being attached on one side to supporting bearing edges of the roof trusses and to intermediate panel points of said trusses and, on the other side, to said top chord of the auxiliary truss, the connecting means that are attached to one of the bearing edges of each one of said roof trusses being made as hinged bearings immovable in all directions while the remaining connecting means are made as hinged bearings permitting of relative movement of said space structures and said top chord of the auxiliary truss in a direction parallel to the line of inclination of said top chord of the auxiliary truss and all said means are spaced from each other through distances sufficient for ensuring the buckling stability of the top chord of the auxiliary truss.

Such an arrangement of the roof covering for a building provides a possibility of using the same space structures for covering double, triple and even larger spans without modifying the structures, which helps to expand the sphere of actual application of said space structures.

Other objects and advantages of the present invention will become apparent upon considering the following detailed description of possible embodiments thereof, with due reference for the accompanying drawings in which.

Figure 1:
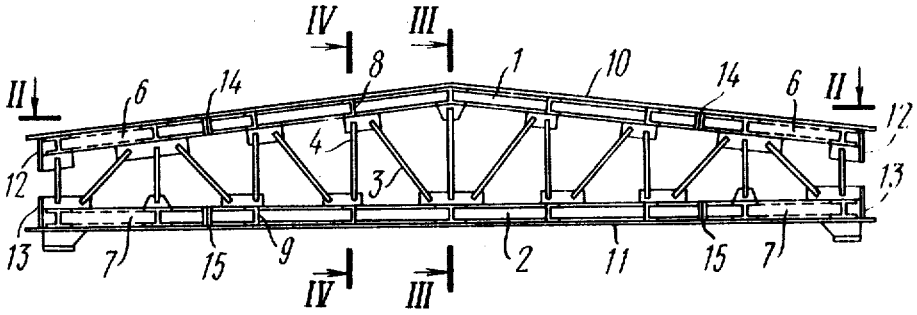
FIG. 1 is a longitudinal sectional view of the structure according to the present invention, incorporating at least two roof trusses.
Figure 17:
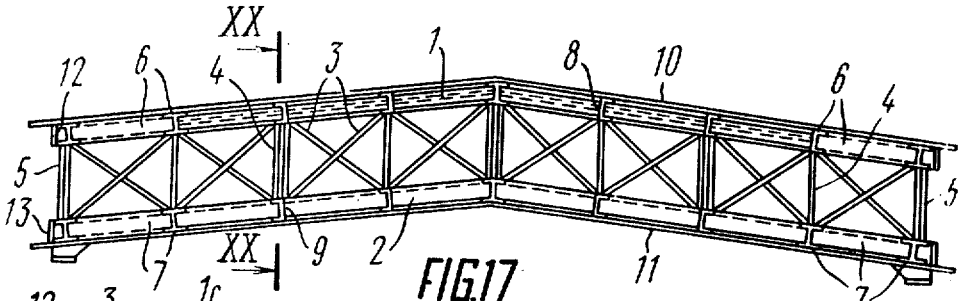
Figure 18:
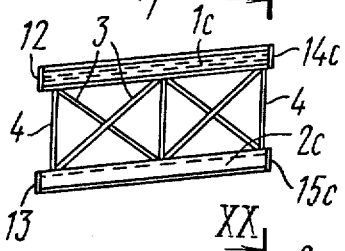
Figure 19:
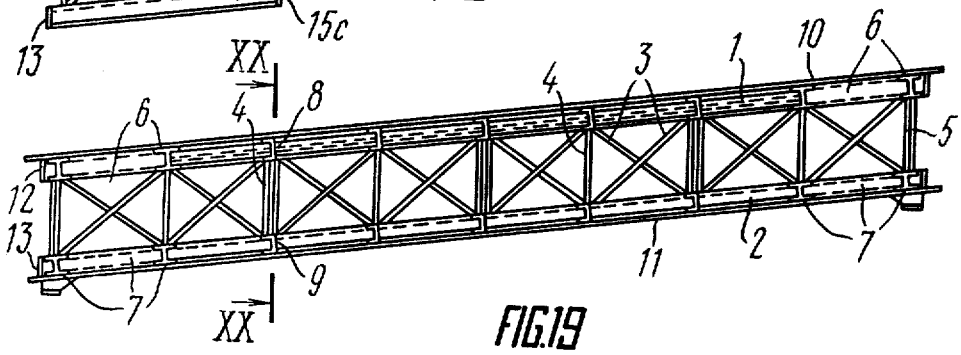
Figure 20:
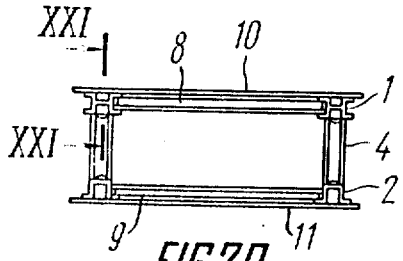
Figure 21:
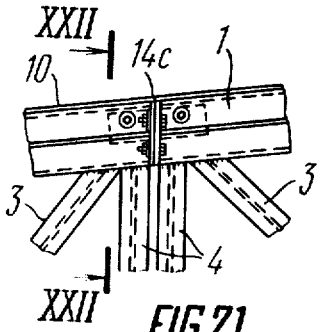
Figure 22:
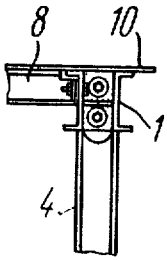
Figure 23:
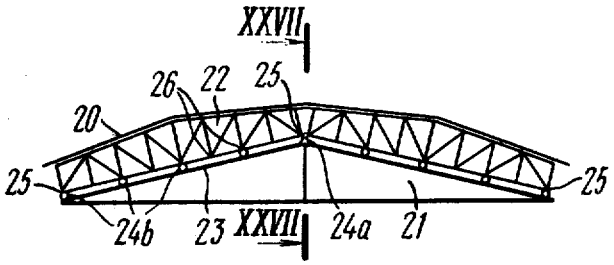
Figure 24:
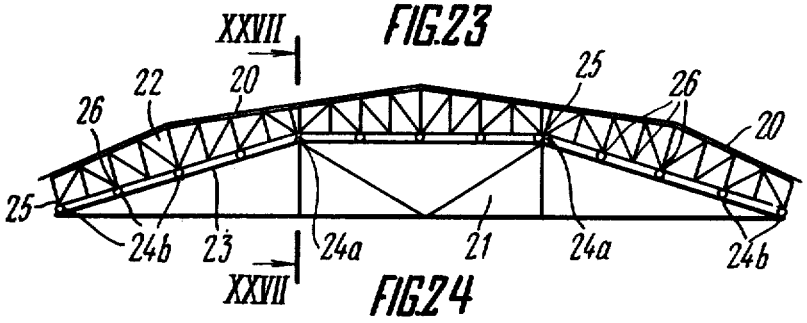
Figure 25:
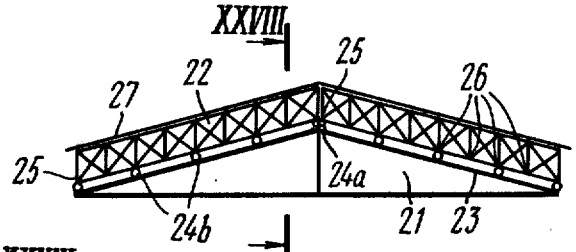
Figure 26:
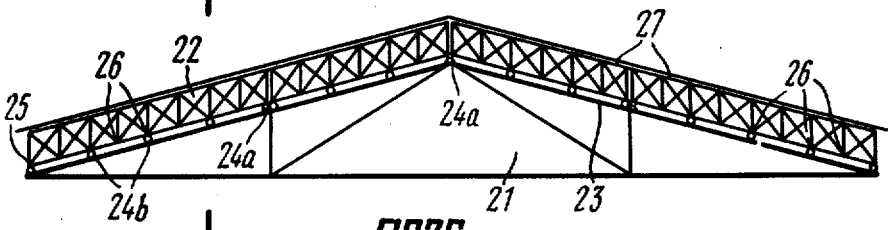
Figure 27:
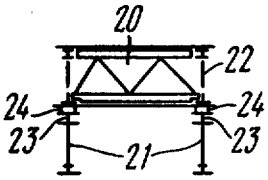

FIG. 17 is a longitudinal sectional view of the structure according to the present invention, for an embodiment incorporating at least two roof trusses having a top chord and a bottom chord parallel with each other, said structure assembled from unified web parts, with a double pitch of roofing; this section incorporates a longitudinal section of the structure according to the present invention, for an embodiment incorporating at least one roof truss, assembled from unified web parts and having props, suspenders and sectional abutment girder members and purlins;

FIG. 18 shows one of the unified web parts used in the assembly of the structure according to the present invention, as shown in FIGS. 17, 19;

FIG. 19 is a longitudinal sectional view of the structure according to the present invention, shown in FIG. 17, for an embodiment with one-way pitch; this section incorporates longitudinal sections of the embodiments of the herein disclosed structure, similar with those shown in FIG. 17;

FIG. 20 is a section taken on the line XX—XX of FIGS. 17 and 19, for an embodiment of the herein disclosed structure incorporating at least two roof trusses assembled from unified web parts;

FIG. 21 is a section taken on the line XXI—XII of FIG. 20;

FIG. 22 is a section taken on the line XXII—XXII of FIG. 21;

FIG. 23 illustrates an embodiment of the structure according to the present invention, in the form of blocks incorporating two space structures of FIG. 1;

FIG. 24 illustrates an embodiment of the structure according to the present invention, in the form of blocks incorporating three space structures of FIG. 1;

FIG. 25 illustrates an embodiment of the structure according to the present invention, in the form of blocks incorporating two space structures of FIG. 19;

FIG. 26 illustrates an embodiment of the structure according to the present invention, in the form of blocks incorporating four space structures of FIG. 19;

FIG. 27 is a section taken on the line XXVII—XXVII of FIGS. 23, 24; and

Figure 28:
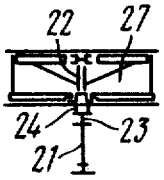

FIG. 28 is a section taken on the line XXVIII—XXVIII of FIGS. 25, 26.

When describing the examplary embodiments of the present invention, as illustrated in the accompanying drawings, concrete narrow terminology has been used for the sake of clarity. However, the invention is not limited by the terms adopted, and it should be borne in mind that each of these terms embraces all the equivalent elements working analogously and used to solve similar problems.

Figure 3:
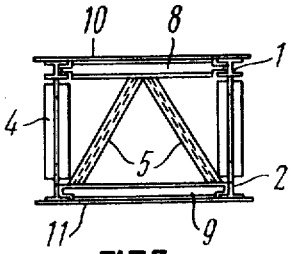
FIG. 3 is a section taken on the line III—III of FIG. 1.
Figure 4:
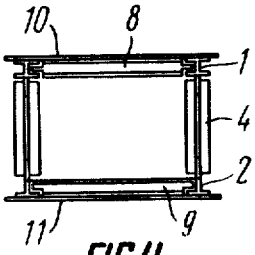
FIG. 4 is a section taken on the line IV—IV of FIG. 1.

The space structure of a roof covering for a building of the present invention (cf., FIGS. 1, 2) comprises: at least two roof trusses, each comprising a top longitudinal chord 1 and a bottom longitudinal chord 2, diagonals 3 and verticals 4 by means of which the top chord 1 is connected to the bottom chord 2; cross braces 5 (FIG. 3) located in the vertical planes of cross-section of said space structure, said cross braces serving to interconnect the roof trusses and mounted at the ends of the structure and in the intermediate planes of cross-section between the structure ends at distances sufficient to ensure lateral rigidity of said structure; top 6 and bottom 7 abutment girder members provided at the ends of the top 1 and bottom 2 chords, respectively, and top 8 and bottom 9 purlins mounted between the respective top 6 and bottom 7 abutment girder members at the same levels therewith in the panel points of said trusses, the top 6 and bottom 7 abutment girder members and the top 8 and bottom 9 purlins being connected to the top 1 and bottom 2 chords, respectively, of said trusses (FIGS. 3, 4); a top 10 and bottom 11 prestressed sheet coverings supported by the top 6 and bottom 7 abutment girder members and by the top 8 and bottom 9 purlins, respectively, and attached to said abutment girder members and purlins and to the respective top 1 and bottom 2 chords, the top 6 and bottom 7 abutment girder members keeping the respective top 10 and bottom 11 sheet coverings tensioned and the respective top 1 and bottom 2 chords—compressed; top 12 and bottom 13 flanges for securing said space structure to external means by which the top 10 and bottom 11 sheet coverings are tensioned, respectively, said flanges attached to the end faces of the respective top 1 and bottom 2 chords; in which structure, according to the invention, the top 1 and bottom 2 chords of each truss are made sectional lengthwise, with connections 14 between the sections of the top chord 1 and connections 15 between the sections of the bottom chord 2 made rigid.

Figure 6:
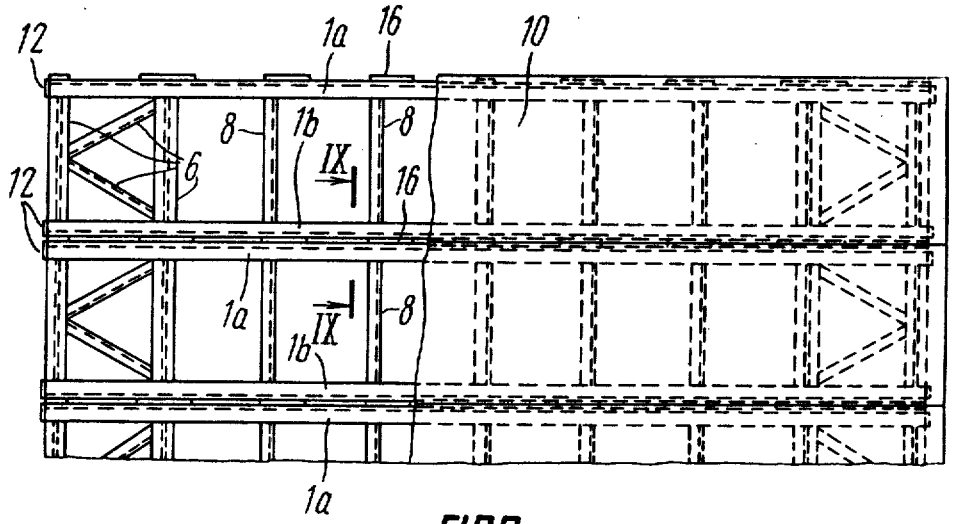
FIG. 6 is a view taken along the line VI—VI of FIG. 5.
Figure 7:
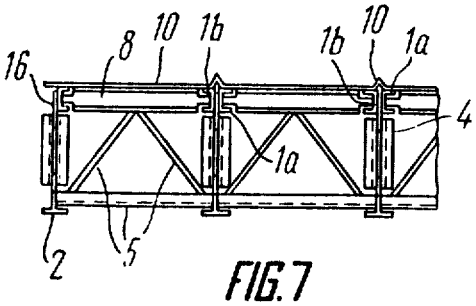
FIG. 7 is a section taken on the line VII—VII of FIG. 5.
Figure 8:
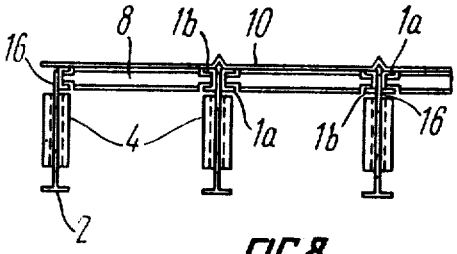
FIG. 8 is a section taken on the line VIII—VIII of FIG. 5.
Figure 9:
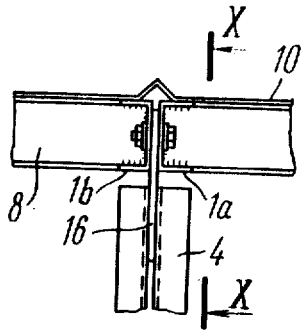
FIG. 9 is a section taken on the line IX—IX of FIG. 5.
Figure 10:
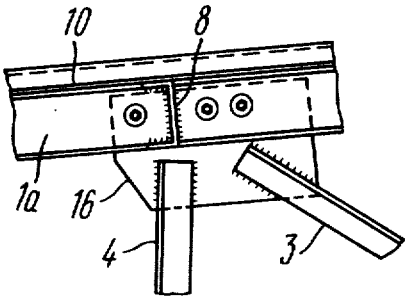
FIG. 10 is a section taken on the line X—X of FIG. 5.

In order to simplify the manufacturing process and reduce the labor consumption in assembly, disclosure is made of a space structure of a roof covering for a building (FIGS. 5, 6), incorporating: at least three roof trusses, each comprising a top longitudinal chord 1 and a bottom longitudinal chord 2, diagonals 3, verticals 4 and gusset plates 16 by means of which the diagonals 3 and verticals 4 connect the top chord 1 with the bottom chord 2; cross braces 5 (FIG. 7) located in the vertical planes of cross-section of said space structure, said cross braces serving to interconnect said roof trusses and mounted at the ends of the structure and in the intermediate planes of cross-section between the structure ends at distances sufficient to ensure lateral rigidity of said structure; top abutment girder means 6 provided at the ends of the top chords 1 of each one of said trusses, and top purlins 8 arranged between the abutment girder members 6 at the same level therewith in the panel points of said trusses, the abutment girders members 6 and purlins 8 being connected to the top chords 1 (FIGS. 7, 8); a top prestressed sheet covering 10 supported by the abutment girder members 6 and purlins 8 and attached to said abutment girder members and purlins and to the top chord 1, the abutment girder members 6 keeping the sheet covering 10 tensioned and the top chord 1—compressed; flanges 12 for securing said space structure to external means by which the sheet covering 10 is tensioned, said flanges attached to the end faces of the top chords 1 of said trusses; in which structure, according to the invention, the top chord 1 of each one of the roof trusses is made up of two longitudinal sections 1*a* and 1*b* (FIG. 6) arranged in parallel with each other, one of said sections 1*a* of the top chord 1 of one of said trusses being connected with the other part 1*b* of the top chord 1 of another truss nearest it by means of the abutment girder members 6, purlins 8 (FIGS. 7, 8) and sheet coverings 10 to form a substantially flat panel extended in the longitudinal direction, while adjacent longitudinal sections 1*a* and 1*b* of the top chord 1 of each truss, belonging to two adjoining ones of said panels, are interconnected by means of the gusset plates 16 (FIGS. 9, 10) provided between the adjacent sections 1*a* and 1*b* of the top chord 1 in places where the diagonals 3 and verticals 4 are attached to the top chord 1 of each one of said trusses.

Figure 12:
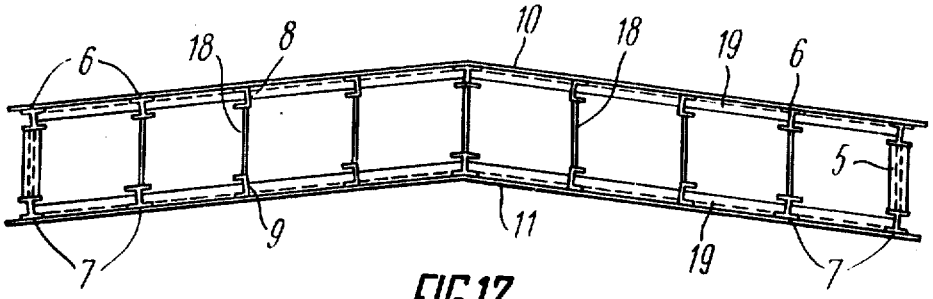
FIG. 12 shows a side elevation of the structure according to the present invention, parallel with the longitudinal section of FIG. 11.
Figure 13:
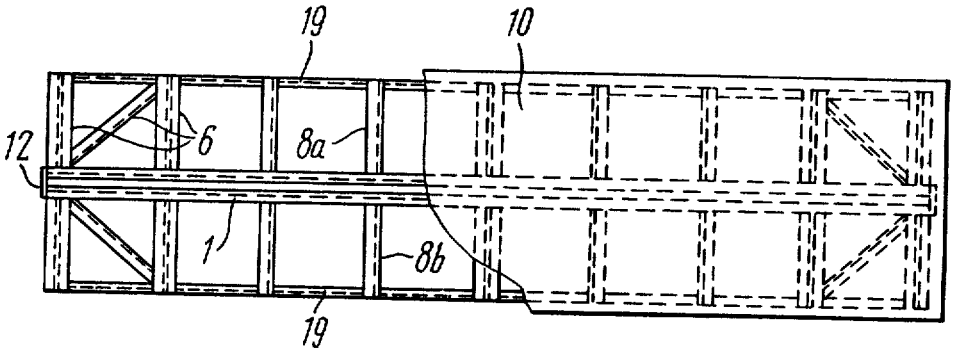
FIG. 13 is a view taken along the line XIII—XIII of FIG. 11.
Figure 14:
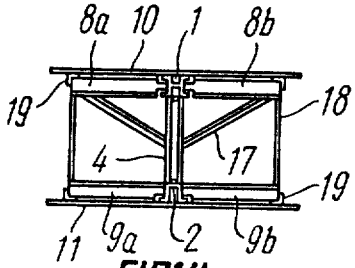
FIG. 14 is a section taken on the line XIV—XIV of FIG. 11.
Figure 15:
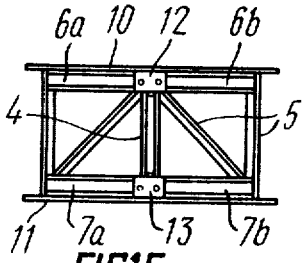
FIG. 15 is a view taken along the line XV—XV of FIG. 11.
Figure 16:
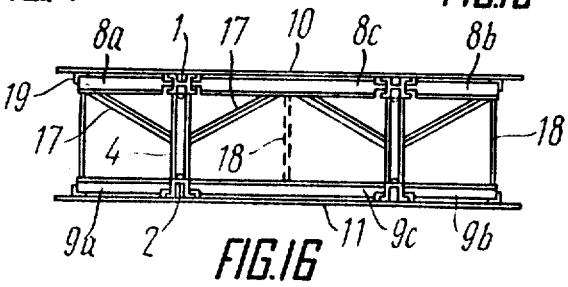
FIG. 16 is a version of a cross-sectional view of the structure according to the present invention, shown in FIG. 11, when manufactured of two roof trusses.

In order to reduce the own weight of a roof covering, disclosure is made of a space structure of a roof covering for a building (FIGS. 11, 12, 13), incorporating: at least one roof truss comprising a top longitudinal chord 1 and a bottom longitudinal chord 2, diagonals 3 and verticals 4 by means of which the top chord 1 is connected to the bottom chord 2; cross braces 5 (FIG. 15) located in the vertical planes of cross-section of said space structure and mounted at the ends of the latter and in the intermediate planes of cross-section between said ends at distances sufficient to ensure lateral rigidity of said structure; top 6 and bottom 7 abutment girder memmers provided at the ends of the respective top 1 and bottom 2 chords, and top 8 and bottom 9 purlins arranged between the respective top 6 and bottom 7 abutment girder members at the same levels therewith in the panel points of said truss, the top 6 and bottom 7 abutment girder members and top 8 and bottom 9 purlins being connected to the top 1 and bottom 2 chords (FIGS. 14, 16), respectively; a top prestressed sheet covering 10 and a bottom prestressed sheet covering 11, supported by said top 6 and bottom 7 abutment girder members and top 8 and bottom 9 purlins, respectively, and attached thereto, the top 6 and bottom 7 abutment girder members keeping the respective top 10 and bottom 11 prestressed sheet coverings tensioned and the respective top 1 and bottom 2 chords—compressed; top 12 and bottom 13 flanges (FIG. 15) for securing said space structure to external means by which the respective top 10 and bottom 11 sheets coverings, are tensioned, said flanges attached to the end of the respective top 1 and bottom 2 chords; props 17 (FIG. 14, 16) each resting with one of its ends against one of the verticals 4 of said truss and, with another ends, connected to the top abutment girder members 6 and top purlins 8, and suspenders 18 (FIGS. 12, 14, 16) serving to connect the external ends of the top abutment girder members 6 and top purlins 8 with the respective ends of the bottom abutment girder members 7 and bottom purlins 9; in which structure, according to the invention, the top 6 and bottom 7 abutment girder members and top 8 and bottom 9 purlins are made sectional, the top 1 and bottom 2 chords are parallel with each other and are arranged between sections 6*a* and 6*b*, 7*a* and 7*b* (FIG. 15) of the respective top 6 and bottom 7 abutment girder members and sections 8*a* and 8*b*, 9*a* and 9*b* (FIG. 14) of the respective top 8 and bottom 9 purlins, while the top 10 and bottom 11 sheet coverings fit closely the respective upward- and downward-directed surfaces of the top 6 and bottom 7 abutment girder members, top 8 and bottom 9 purlins and top 1 and bottom 2 chords and are attached to said chords.

In the structure embodiment incorporating two and more roof trusses (FIG. 16), there is no need to make sectional the abutment girder members and purlins mounled between the roof trusses, while the need for providing suspenders serving to connect the middle points of purlins 8*c* and 9*c* or the middle points of analogous abutment girder members should be supported in each particular case with calculations for appropriate loads. With any number of roof trusses in the afore-disclosed structure, it is practical to connect the external ends of the sectional abutment girder members and purlins in the planes of location of the cover sheet coverings by means of edging members 19 (FIGS. 13, 14, 16) and attach the sheet coverings to said edging members.

The herein disclosed space structure of a roof covering for a building may have various forms depending upon the shape and type of the roof truss, however, in order to unify the elements of which the structure is formed, it is expedient to use roof trusses with parallel chords (FIGS. 17, 19), with said trusses being manufactured from single unified, mainly, plane web parts (FIG. 18) formed of top chord sections 1*c* connected to bottom chord sections 2*c* by means of the diagonals 3 and verticals 4. In the disclosed structure, said web parts are unified, as well as their component sections 1*c* and 2*c* of the chords 1 and 2, diagonals 3 and verticals 4.

The herein disclosed structure (FIGS. 17, 19) incorporating at least two roof trusses comprising a top chord 1 and a bottom chord 2, diagonals 3 and verticals 4 by means of which the top chord 1 is connected with the bottom chord 2 and manufactured from unified web parts, has a cross-section shown in FIG. 20. As an example, it is suggested to effect a rigid connection of the sections of top chord 1 of the roof trusses assembled from unified parts by way of bolt connection of joint members 14*c* (FIGS. 21, 22), however, other versions of such connection are possible that are not shown in the accompanying drawings.

Another specific embodiment of the disclosed structure incorporating one or more roof trusses with parallel chords (FIGS. 11, 17, 19) involves the manufacture of said roof trusses with gussetless welded joints of some elements of web system such as diagonals and verticals with the top and bottom chords of said trusses (FIGS. 21, 22), which helps automate the welding of said joints.

For expanding the sphere of actual application of the structure according to the present invention, disclosure is made of space structures, as shown in FIG. 1, combined in large blocks of said space structures 20 (FIGS. 23, 14), incorporating at least two space structures 20, at least two auxiliary trusses 21, each one of said auxiliary trusses located in the same plane with one of roof trusses 22 (FIG. 27) incorporated in the space structures 20 and having a top chord 23 parallel with the bottom chords of said roof trusses 22; and connecting means 24 with the aid of which each space structure 20 is connected to the top chords 23 of the auxiliary trusses 21, said connecting means being attached on one side to bearing edges 25 of the roof trusses 22 and to intermediate panel points 26 of said trusses and, on the other side, to the top chords 23 of the auxiliary trusses 21, the connecting means 24 that are attached to one of the bearing edges 25 of each one of the roof trusses 22 being fashioned as hinged bearings 24*a* immovable in all directions while the remaining connecting means 24 are fashioned as hinged bearings 24b permitting of relative movement of the space structures 20 and the top chords 23 of the auxiliary trusses 21 in a direction parallel to the line of inclination of the top chords 23, all said means 24 being spaced from each other through distances sufficient for ensuring the buckling stability of said top chords 23.

Disclosure is also made of a way of combining space structures, as shown in FIG. 19, in large blocks of space structures 27 (FIGS. 25, 26), incorporating at least two space structures 27 (FIG. 28), at least one auxiliary truss 21 mounted in the same plane with a roof truss incorporated in each one of said space structures 27 and having a top chord 23 parallel with the bottom chord of the roof truss 22; and connecting means 24 by means of which each space structure 27 is connected to the top chord 23, said connecting means being attached on one side to bearing edges 25 of the roof trusses 22 and to intermediate panel points 26 of said roof trusses, said latter panel points located between the bearing edges 25, and, on the other side, to the top chord 23, the connecting means 24 that are attached to one of the bearing edges 25 of each one of said roof trusses 22 being fashioned as hinged bearings 24a immovable in all directions while the remaining connecting means 24 are fashioned as hinged bearings 24b permitting of relative movement of the space structures 27 and the top chord 23 in a direction parallel to the line of inclination of said top chord 23, all said means 24 being spaced from each other through distances sufficient to ensure the buckling stability of the top chord 23.

Let us consider in detail the performance of the herein disclosed space structure of a roof covering for a building.

Figure 2:
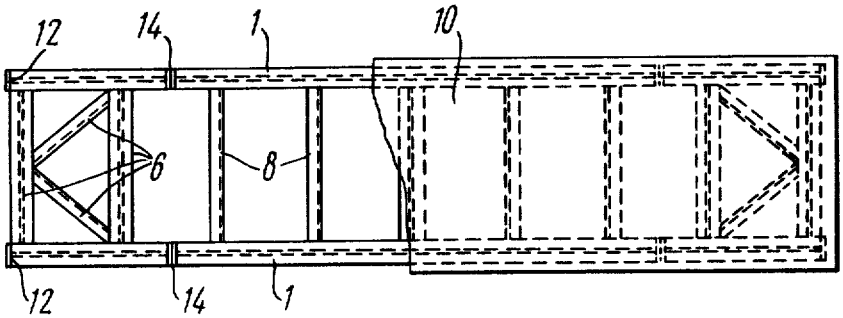
FIG. 2 is a view taken along the line III—III of FIG. 1.

The main load-bearing part of the disclosed structure shown in FIGS. 1 and 2 consists of the roof trusses comprising the top chord 1 and the bottom chord 2, diagonals 3 and verticals 4 by means of which the top chord 1 is connected with the bottom chord 2. Said trusses can have any outline, in accordance with the operating requirements and other considerations. Also provided in the disclosed structure are the top 6 and bottom 7 abutment girder members and the top 8 and bottom 9 purlins, supporting the respective top 10 and bottom 11 prestressed sheet coverings, and the top 12 and bottom 13 flanges for securing said space structure to external means by which said sheet coverings are tensioned, the flanges being attached to the end faces of the respective chords. From the moment of tensioning the sheet coverings and until the beginning of its performance, the disclosed structure is subjected to influences of two types: first, mutual influence of the pretensioned sheet coverings 10 and 11 and respective precompressed longitudinal chords 1 and 2 transmitted from the former to the latter and vice versa via abutment girder members 6 and 7 which are also designed to ensure a more uniform distribution of stresses in the sheet coverings throughout their width and, second, said structure is subjected in the course of assembly and in the following working period to the effect of external loads such as the own weight of the structure, weight of the heat-insulating materials, weight of the processing equipment, weight of snow on the roofing, the effect of wind, etc. The majority of said loads act in a downward direction. While so doing, tension forces emerge in the top chords 1 and compressive forces—in the bottom chords 2. The prestressing of the top sheet covering 10 made of a thin coiled sheet and its connection with the compressed top chord 1 imparts to said sheet covering an ability of, first, taking up compressive forces from the external loads effective in said compressed top chord 1 and, second, responding to said forces together with said chord 1 as a single element. Owing to this ability of the top prestressed sheet covering to perform as a compressed element, the static deflection of the overall structure when acted upon by a load applied from above is reduced considerably. The prestressing of the bottom sheet covering 11 is done with a view to eliminating sheet defects such as longitudinal and lateral ridges which may occur after the rolling of the sheets, their storage and after transportation of the coils to the site of assembly. Therefore, the force of prestressing the top sheet covering 10 is based on the condition of its participation in the work of the compressed top chord 1 until the load-bearing capacity of the latter is used up, and exceeds the value of prestressing the bottom sheet covering 11.

The structures shown in FIGS. 1, 11, 17 and 19 are manufactured in the following order. A space frame is assembled, including roof trusses, the top 6 and bottom 7 abutment girder members and top 8 and bottom 9 purlins, as well as the cross braces 5 which help to ensure the space stability of said frame, the top 1 and bottom 2 longitudinal chords of said trusses having, attached to their end faces, the flanges 12 and 13 for securing said space structure to external means by which the sheet coverings are tensioned. Thereupon, said external means are connected to the flanges 12 and 13, followed with installing the sheet coverings 10 and 11 and attaching to the abutment girders members 6 and 7 one of the ends of each sheet covering. The opposite ends of both sheet coverings are attached to said external tensioning means connected with said flanges 12 and 13 of the structure at the opposite end of the latter and, by means of said external means, the sheet coverings are tensioned. While tensioning each sheet covering 10 and 11, the chords 1 and 2 of the roof trusses are compressed concurrently since said external means are thrust against the flanges 12 and 13 of the chords 1 and 2. After tensioning both sheet coverings, they are connected to the respective abutment girder members 6 and 7, purlins 8 and 9 and chords 1 and 2, followed by cutting off the end of each sheet covering connected to said external means. Then, the external means are disconnected from the flanges and the finished structure is delivered to the assembly stage where, prior to its being mounted in the roof covering, a heat insulator is laid out and requisite parts are mounted for subsequent attachment of processing equipment, lighting equipment, etc. After the structure has been installed in the roof covering, only one operation is performed at high altitude, namely, that of joining the top sheet coverings 10 between each two of said space structures in longitudinal direction.

Figure 5:
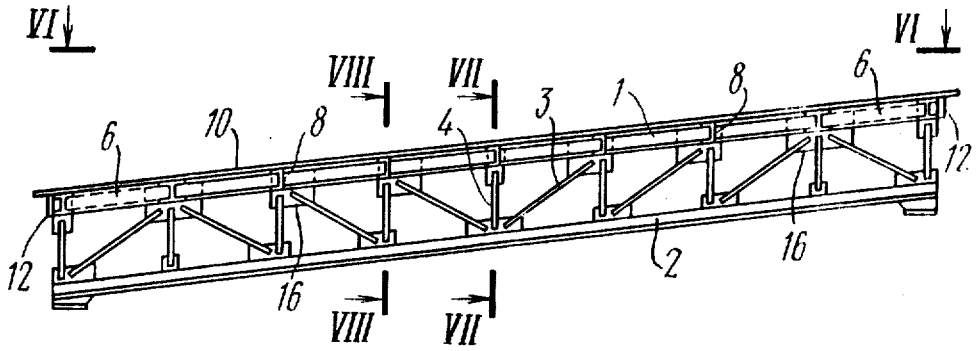
FIG. 5 is a longitudinal sectional view of the structure according to the present invention, incorporating at least three roof trusses.

The structure shown in FIG. 5 is manufactured as follows. Separately manufactured are plane panel frames consisting of two longitudinal chords 1a and 1b, two abutment girder members 6 and purlins 8 whose number and position in the panel frames corresponds to the number and position of the roof truss panel points. At the same time, roof trusses are manufactured, comprising bottom chords 2, diagonals 3, verticals 4 and gusset plates 16. Then, external tensioning means are attached to the flanges 12 secured to the end faces of the longitudinal chords 1, and the sheet covering 10 is placed under the frame, one of the sheet coverings ends being attached to one of the abutment girder members 6 and the other end—to said tensioning means, after which the sheet covering is tensioned by means of the tensioning means. After the sheet covering has been tensioned, it is attached to the other abutment girder member 6, purlins 8 and chords 1*a* and 1*b*, while the sheet covering end secured to the external tensioning means is cut off. The thus manufactured panels are mounted in an assembly building berth containing the required number of roof trusses, with the gusset plates 16 located in the top panel points of the roof trusses taking position between two adjacent longitudinal chords 1*a* and 1*b* of the adjoining panels in their longitudinal junction. Then, said adjacent chords are connected with each other by means of said gusset plates, and the sheet coverings of the adjoining panels are joined in a longitudinal junction. The resulting space structure is mounted in the roof covering of a building, and the longitudinal junctions of the cover sheets 10 between two such structures are joined.

Figure 11:
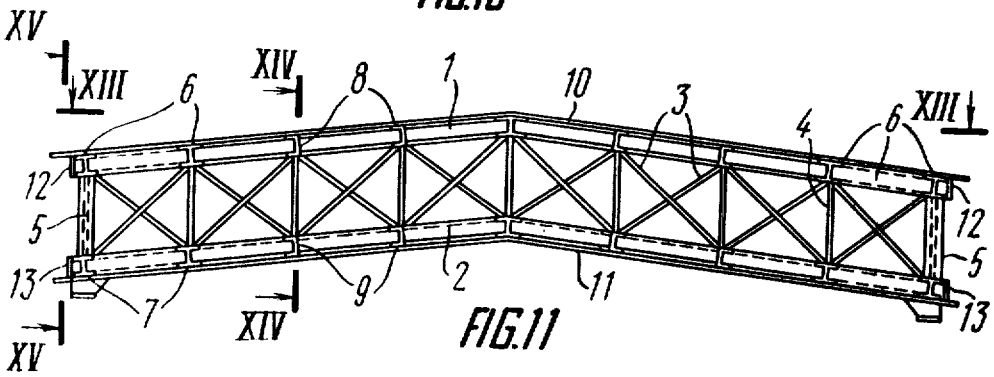
FIG. 11 is a longitudinal sectional view of the structure according to the present invention, incorporating at least one roof truss and sectional abutment girder members and purlins.

The performance of the structure shown in FIG. 11 under the effect of external loads and its manufacture are similar with those of the afore-described structure shown in FIGS. 1, 2.

The performance of the structure shown in FIGS. 17, 19 under the effect of external loads is similar with that of the afore-described structures shown in FIGS. 1, 5, 11. The manufacturing sequence of the structure shown in FIGS. 17, 19 is as follows. Unified web parts are manufactured, similar to that shown in FIG. 18, including sections 1*c* and 2*c* of the top 1 and bottom 2 chords, interconnected by means of the diagonals 3 and verticals 4. Several unified parts, as shown in FIG. 18, are used to assemble roof trusses by way of rigid connection of the top chord sections 1*c* of one unified part with an analogous top chord section 1*c* of another unified part and of a bottom chord section 2*c* of said one unified part with an analogous bottom chord section 2*c* of the other part. By successive addition of the required number of such unified parts in the above-described manner, the roof trusses are manufactured. Thereupon, the disclosed structure is assembled and the top and bottom sheet coverings tensioned in the same sequence as described with reference to the structure shown in FIG. 1.

The structure shown in FIGS. 23, 24 performs in the following manner. The space structures 20 making up a block are acted upon by external loads, each in its own span, and transmit the effect of all the loads applied to these structures onto the auxiliary truss 21 in the form of concentrated forces equal in magnitude to the supporting reactions of said space structures. The effect of said concentrated forces causes the emergence of compressive forces in the top chord 23 of the auxiliary truss 21. In order to ensure the buckling stability of the compressed top chords 23 use is made of the connecting means 24 attached on one side to said compressed chords 23 and, on the other side, to the space structures mounted thereabove. While so doing, the connecting means attached to one of the bearing edges 25 of each roof truss 22 is fashioned as a hinged bearing 24*a* ensuring the immobility of said bearing edges in all directions, while the remaining connecting means, including those mounted in the other bearing edge 25 of each roof truss 22 and in some of its intermediate panel points 26, are fashioned as hinged bearings permitting of relative movement of all of the intermediate panel points of the roof truss and respective points of the top chord 23 of the auxiliary truss 21 in a direction parallel to the line of inclination of the top chord 23. With such an arrangement of the connecting means 24, the buckling stability of the top chord 23 in the plane of the auxiliary truss 21 and out of its plane is ensured even in the case of static deflection of the space structures, not exceeding the limits of building regulations and standards since the accompanying stresses caused by the bending of the top chord 23 are too small. In addition, said stresses caused by the bending of the top chord 23 and the eccentricities of said chord axis due to such bending can be easily eliminated by making the top chord sectional, with the sections articulated in the places of joining the connecting means 24.

The herein disclosed space structure of a roof covering for a building features a number of advantages, in particular, the structure according to the present invention ensures a simpler manufacturing process and lower labor consumption in manufacture and assembly, improved reliability of the structure, reduced weight of the structure, as well as the possibility of the mass production of the structures using means of mechanizing and automating the manufacturing process thanks to unification and, finally, the expansion of the sphere of actual application of such structures in buildings with different spans.

What is claimed is:

1. A space structure of a roof covering for a building, incorporating: at leat two roof trusses, each comprising a top longitudinal chord and a bottom longitudinal chord, diagonal rods and vertical posts, by means of which said top chord is connected with said bottom chord; cross braces located in the vertical planes of cross-section of said space structure, said cross braces serving to interconnect said roof trusses and being mounted at the ends of said structure and in the intermediate planes of cross-section between the structure ends at distances sufficient to ensure lateral rigidity of said structure; top and bottom abutment girder members provided at the ends of said top and bottom chords, respectively, and top and bottom purlins arranged between said top and bottom abutment girder members, respectively, at the same levels therewith in panel points of said trusses, said top and bottom abutment girder members and top and bottom purlin being connected to the top and bottom chords, respectively; a top prestressed sheet covering and a bottom prestressed sheet covering, supported by the top and bottom abutment girder members and purlins, respectively, and attached to said members and purlins and to said top and bottom chords, respectively, said top and bottom abutment girder members keeping said respective top and bottom sheet coverings tensioned and said respective top and bottom chords compressed; top and bottom flanges for securing said space structure to external means by which said top and bottom sheet coverings are tensioned, said flanges attached to the end faces of said top and bottom chords, respectively; said space structure wherein said top and bottom chords are made sectional lengthwise, with the connection between the sections of the top chords as well as the sections of the bottom chords made rigid.

2. A space structure of a roof covering for a building, incorporating: at least three roof trusses, each comprising a top longitudinal chord and a bottom longitudinal chord, diagonals, verticals and gusset plates with the aid of which said diagonals and verticals connect said top chord with said bottom chord; cross braces located in the vertical planes of cross-section of said space structure, said cross braces serving to interconnect said roof trusses and being mounted at the ends of said structure and in the intermediate planes of cross-section between the structure ends at distances sufficient to ensure lateral rigidity of said structure; top abutment girder members provided at the ends of said top chords of each one of said roof trusses, and top purlins arranged between said top abutment girder members at the same level therewith in panel points of said trusses, said abutment girder members and purlins being connected to said top chords; a top prestressed sheet covering supported by said top abutment girder members and purlins and attached to said members and purlins and to said top chord, said abutment girder members keeping said sheet covering tensioned and said top chord compressed; flanges for securing said space structure to external means by which said top sheet covering is tensioned, said flanges attached to the end faces of said top chords of said roof trusses; said space structure wherein the top chord of each one of said trusses is made up of two longitudinal sections arranged in parallel with each other, one of said sections of the top chord of one of the trusses being connected with the other one of the sections of the top chord of another truss nearest to it by means of said abutment girder members, purlins and sheet covering to form a substantially flat panel extended in the longitudinal direction, while adjacent longitudinal sections of said top chord of each truss, belonging to two adjoining ones of said panels, are interconnected by means of said gusset plates provided between said adjacent sections of said top chord, in places where said diagonals and verticals are attached to said top chord of each one of said trusses.

3. A space structure of a roof covering for a building, incorporating: at least one roof truss comprising a top longitudinal chord and a bottom longitudinal chord, diagonals and verticals by means of which said top chord is connected with said bottom chord; cross braces located in the vertical planes of cross-section of said space structure and mounted at the ends of the latter and in the intermediate planes of cross-section between said ends at distances sufficient to ensure lateral rigidity of said structure; top and bottom abutment girder members provided at the ends of said top and bottom chords, respectively, and top and bottom purlins arranged between said top and bottom abutment girder members, respectively, at the same levels therewith in panel points of said truss, said top and bottom abutment girder members and top and bottom purlins being connected to the top and bottom chords, respectively; a top prestressed sheet covering and a bottom prestressed sheet covering, supported by said top and bottom abutment girder members and purlins, respectively, and connected thereto, said top and bottom abutment girder members keeping said respective top and bottom sheet coverings tensioned and said respective top and bottom chords compressed; top and bottom flanges for securing said space structure to external means by which said top and bottom sheet coverings are tensioned, said flanges attached to the end faces of said top and bottom chords, respectively; props, each resting with one of its ends against one of the verticals of said truss and, with another end, connected to said top abutment girder members and purlins, and suspenders serving to connect the external ends of said top abutment girder members and purlins with the respective ends of said bottom abutment girder members and purlins; said space structure wherein said top and bottom abutment girder members and purlins are made sectional, said top and bottom chords are parallel with each other and are arranged between sections of said top and bottom abutment girder members and purlins, while said top and bottom sheet coverings fit closely the upward- and downward-directed surfaces, respectively, of said respective top and bottom abutment girder members, purlins and chords and are attached to the latter.

4. A space structure of a roof covering for a building, as claimed in claim 1, wherein said top chords of said trusses are parallel with the bottom chords of said trusses, while said sections of the top chords, connected with the respective sections of the bottom chords by means of said diagonals and verticals, form unified, mainly plane web parts.

5. A space structure of a roof covering for a building, as claimed in claim 3, wherein said top and bottom chords of said truss are made sectional lengthwise, and the sections of said top chord, connected to the respective sections of said bottom chord by means of said diagonals and verticals, form unified, mainly plane web parts, with the connections between said sections of the top chord and the connections between said sections of the bottom chord made rigid.

6. A block of space structures of a roof covering for a building in accordance with claim 1, incorporating: at least two of said structures; at least two auxiliary trusses, each located in the same plane with one of roof trusses incorporated in each one of said space structures, each one of said auxiliary trusses having a top chord parallel with bottom chords of said roof trusses; connecting means with the aid of which each one of said space structures is connected to said top chords of the auxiliary trusses, said connecting means being attached on one side to bearing edges of said roof trusses and to intermediate panel points of said roof trusses located between said bearing edges and, on the other side, to said top chords of said auxiliary trusses, the connecting means attached to one of the bearing edges of each one of said roof trusses being made as hinged bearings immovable in all directions while the remaining connecting means are made as hinged bearings permitting of relative movement of said space structures and said top chords of the auxiliary trusses in a direction parallel to the line of inclination of said top chords of the auxiliary trusses, all said means being spaced from each other through distances sufficient for ensuring the buckling stability of said top chords of the auxiliary trusses.

7. A block of space structures of a roof covering for a building in accordance with claim 5, incorporating: at least two of said structures; at least one auxiliary truss located in the same plane with the roof truss incorporated in each one of said space structures, said auxiliary truss having a top chord parallel with bottom chords of said roof trusses; connecting means with the aid of which each one of said space structures is connected to said top chord of the auxiliary truss, said connecting means being attached on one side to bearing edges of said roof trusses and to intermediate panel points of said roof trusses located between said bearing edges and, on the other side, to said top chord of said auxiliary truss, the connecting means attached to one of the bearing edges of each one of said roof trusses being made as hinged bearings immovable in all directions while the remaining connecting means are made as hinged bearings permitting of relative movement of said space structures and said top chord of said auxiliary truss in a direction parallel to the line of inclination of said top chord of the auxiliary truss, all said means being spaced from each other through distances sufficient for ensuring the buckling stability of said top chord of the auxiliary truss.

* * * * *